US006213461B1

(12) United States Patent
Ratz et al.

(10) Patent No.: US 6,213,461 B1
(45) Date of Patent: Apr. 10, 2001

(54) DEVICE FOR GUIDING PRINTING PRODUCTS

(75) Inventors: Holger Ratz; Rudolf Stäb, both of Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/269,767

(22) PCT Filed: Oct. 8, 1997

(86) PCT No.: PCT/DE97/02302

§ 371 Date: Apr. 9, 1999

§ 102(e) Date: Apr. 9, 1999

(87) PCT Pub. No.: WO98/16456

PCT Pub. Date: Apr. 23, 1998

(30) Foreign Application Priority Data

Oct. 12, 1996 (DE) ..... 196 42 185

(51) Int. Cl.[7] ..... B65H 29/00; B65H 29/66; B65H 5/02; B65H 5/04

(52) U.S. Cl. ..... 271/187; 271/216; 271/277; 198/470.1; 198/644; 198/803.7; 198/803.14

(58) Field of Search ..... 271/187, 216, 271/237, 227; 198/420.1, 644, 803.7, 803.14, 851, 187, 216, 237, 277, 470.1

(56) References Cited

U.S. PATENT DOCUMENTS

| | | | | |
|---|---|---|---|---|
| 4,201,286 | * | 5/1980 | Meier | 198/461 X |
| 4,519,509 | * | 5/1985 | Doyle | 211/119.13 |
| 4,556,212 | | 12/1985 | Nogi et al. | 271/315 |
| 4,647,032 | | 3/1987 | Oba | 271/186 |
| 4,925,173 | | 5/1990 | Lindblom et al. | 270/52.14 |
| 5,197,585 | * | 3/1993 | Blood | 198/384 X |
| 5,261,656 | * | 11/1993 | Gutov et al. | 271/243 X |
| 5,328,017 | * | 7/1994 | Carlen | 198/365 X |
| 5,380,000 | | 1/1995 | Ohno | 271/277 |
| 5,518,231 | * | 5/1996 | Teddy | 271/277 |

FOREIGN PATENT DOCUMENTS

| | | |
|---|---|---|
| 682230 | 8/1991 | (CH) . |
| 279230 | 5/1913 | (DE) . |
| 697189 | 6/1939 | (DE) . |
| 3725225 | 7/1987 | (DE) . |
| 0 359 727 | 3/1990 | (EP) . |
| 0 482 359 | 9/1991 | (EP) . |

* cited by examiner

*Primary Examiner*—Christopher P. Ellis
*Assistant Examiner*—Kenneth W Bower
(74) *Attorney, Agent, or Firm*—Jones, Tullar & Cooper PC

(57) ABSTRACT

Printed products are guided from an infeed to a delivery belt by a plurality of partially overlapping paddle blades. The paddle blades are secured to an endless carrier such as a chain or a toothed belt. The printed products are deposited on the delivery belt in a smooth, gentle manner as they slip out of the pockets defined by the adjacent overlapping paddles.

16 Claims, 4 Drawing Sheets

DEVICE FOR GUIDING PRINTING PRODUCTS

FIELD OF THE INVENTION

The present invention relates to a device. A plurality of partially overlapping paddles are pivotably fastened on an endless holder for guiding printed products.

DESCRIPTION OF THE PRIOR ART

A device for delivering printed products from a folding apparatus of a web-fed rotary printing press is known from CH 682 230 A5. This device consists of an endless chain conveyor, on each of whose links a paddle and a clamping element are each arranged. One printed product is respectively received between the paddle and the clamping element and is deposited at another processing station.

The object of the present invention is based on providing a device which delivers printed products in an imbricated or overlapping manner on a delivery belt.

In accordance with the present invention, this object is attained by using a printed product guiding device which utilizes a plurality of pivotable paddles attached to an endless holder. The paddles or blades are partially overlapping and define an arrangement of printed product receiving pockets.

The advantages which can be achieved by means of the present invention reside, in particular, in that, assuming the same production speed, each printed product which has fallen into a paddle pocket can have a dwell time which is several times longer than in a pocket of, for example, a known prior art paddle wheel. Even at high production speeds, the printed products can be steadied and aligned after having been received in the paddle pockets of the present invention.

Because of the pivoting movement of the paddles, the printed products slide more slowly, and therefore are placed in better alignment, on the delivery belt. This is advantageous in particular when using non-curved paddles, which can be produced in a simple manner.

With a further embodiment of the invention, the dwell time of the printed products in the paddle pockets can be extended by means of the arrangement of a delivery path. The printed products can be pushed out of the paddle pocket more gently by means of this arrangement and an improved delivery quality can therefore be achieved.

BRIEF DESCRIPTION OF THE DRAWINGS

The present invention is represented in the drawings by means of several preferred embodiments and will be described in greater detail in what follows.

Shown are in.

DESCRIPTION OF THE PREFERRED EMBODIMENTS

Figure 2:
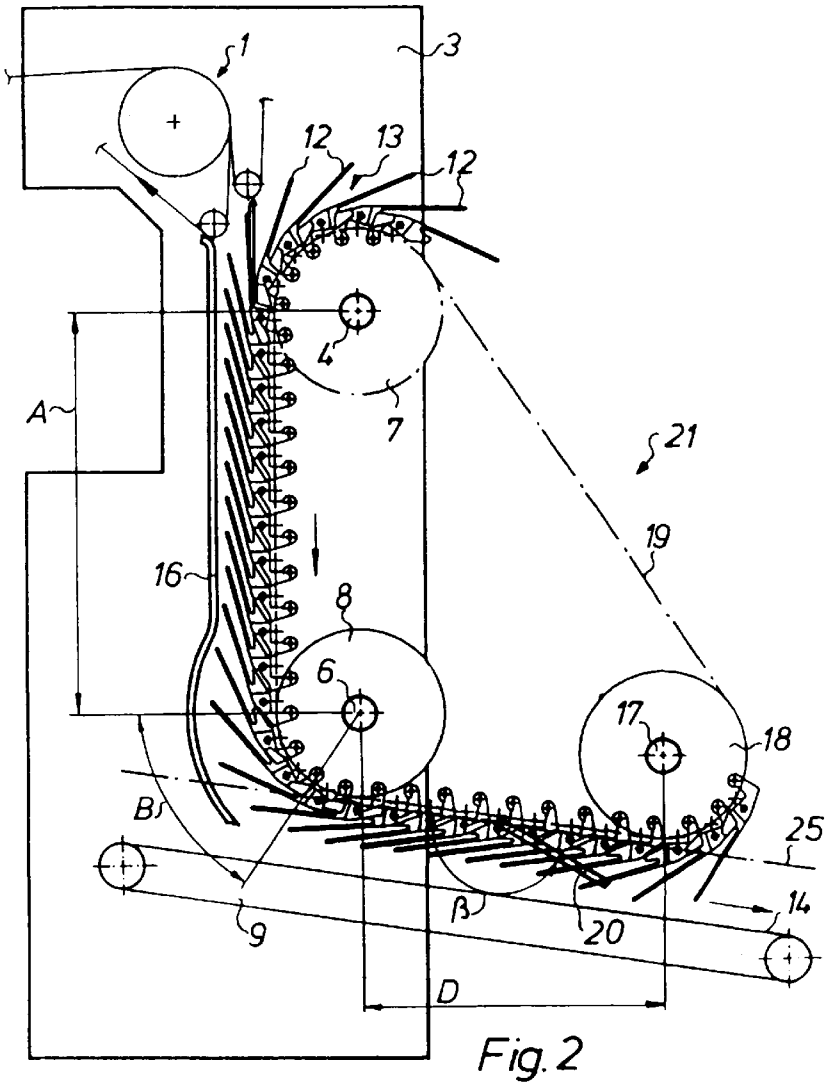
FIG. 2, a representation analogous to FIG. 1, but of a second preferred embodiment with more than two, for example three, chain wheels.
Figure 1:
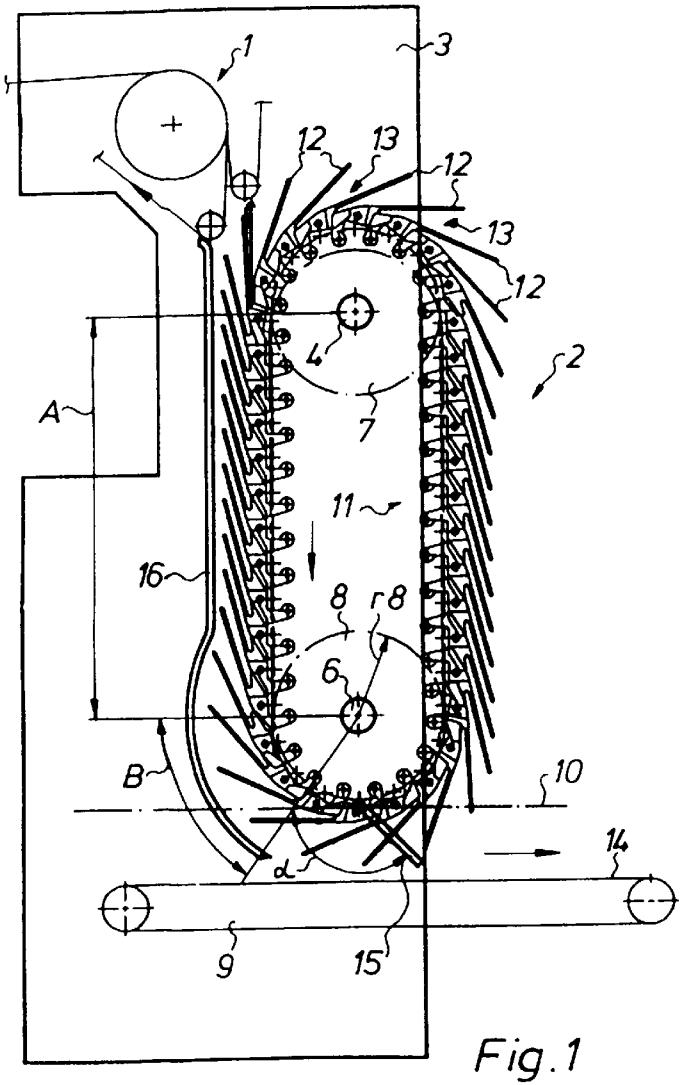
FIG. 1, the schematic representation of a lateral view of a delivery device in a first preferred embodiment with two chain wheels.

A delivery device 2 for printed products is arranged underneath an outlet wedge, for example, of a known belt guide system 1, as seen in FIG 1. The delivery device 2 has two spaced wheels, each respectively fastened on a shaft 4, 6, with the wheels being used for guiding a carrier or traction means. The wheels are designed as chain wheels 7, 8, for example, and the traction means is provided as an endless roller chain 11, for example. The shafts 4, 6 of the chain wheels 7, 8 are seated or supported at their left and right ends on lateral frames—A lateral frame 3 is represented in FIGS. 1 and 2. The chain wheels 7, 8 are arranged one on top of the other, so that the roller chain 11 extends approximately vertically with respect to the direction of a product take-away conveying installation, for example a delivery belt 9 extending in the horizontal direction. The first chain wheel 7 is located in the vicinity of the end of the belt guide system 1 which feeds products to the delivery device 2. The second chain wheel 8 is arranged in the vicinity of the delivery belt 9 which takes products away from the delivery device 2.

Figure 3:
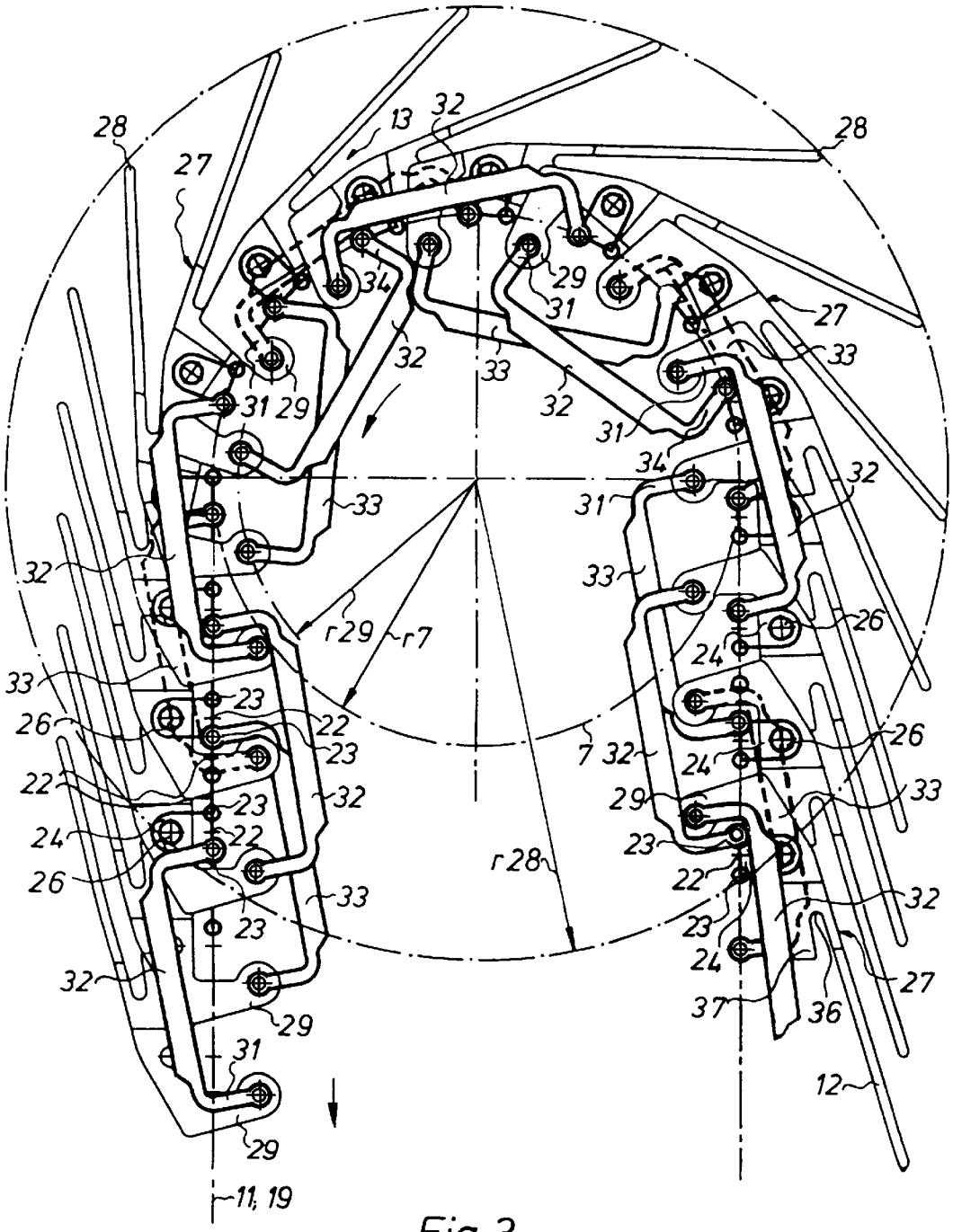
FIG. 3, an enlarged representation of the paddle chain in accordance with FIG. 1, which is guided around the upper chain wheel, but with a lever system which reduces the deflection of the paddle tips when the paddle chain is reversed.

The chain wheels 7, 8 together conduct the endless roller chain 11, which has paddles 12 on its chain links 22 as seen more clearly in FIG 3. The paddles 12 are fastened on the chain links 22 in such a way, that the paddles 12 partially overlap in the manner of fish scales paddle pockets 13, for receiving printed products, are formed between each two paddles 12 arranged one behind the other. These product receiving paddle pockets 13 are open opposite the direction of movement of the roller or paddle chain 11 again as shown in FIGS 1 and 2.

The first chain wheel 7 can be designed as a reversing wheel and the second chain wheel 8 as a drive wheel for the paddle chain 11. The paddle chain 11 moves in a counter-clockwise direction in such a way that a printed product released by the belt system 1 can fall into each paddle pocket 13.

The distance between the upper and lower chain wheels 7, 8 can be greater than the distance between five paddles 12, for example, or also be a multiple of a diameter of a chain wheel 7 or 8. A plurality of paddles 12 can be arranged on the paddle chain 11, for example 35 to 45 such paddles 12 can be carried on the chain 11.

Because of the force of gravity, the printed products can align themselves on a vertical, straight alignment and steadying path A, located between the first and second chain wheel 7, 8 viewed in the running direction of the claim 11. Further alignment of the products takes place on a subsequent curved steadying path B extending in the vertical direction. Alignment of the products in the pockets 13 takes place entirely on the paths A and B.

In accordance with another preferred embodiment, it is possible to arrange two smaller chain wheels, not specifically represented, in place of the second chain wheel 8 used in configuration shown in FIG. 1. In place of the large radius r8 of the claim wheel 8, there would therefore be two smaller radii available for reversing the traction means. The traction means or chain 11 then would extend horizontally between the two smaller radii, for example. A delivery path would then be formed. It is also possible to provide known technical means for aligning the printed products. In this way a defined spacing between the printed products is achieved.

The delivery belt 9, which is itself known per se, is designed in such a way that the upper belt 14 travels in the same direction as the direction of rotation of the second chain wheel 8.

A guide device 16 can be provided along the steadying tracks A, B and is used for supporting the ends of the printed products projecting out of the paddle pockets 13. For example, this guide device 16 can have a plurality of rods arranged next to each other and each extending in the vertical direction.

A known product removed device 15, for use in slipping the printed products out of the pockets 13 is arranged underneath the second chain wheel 8 and extends about at an angle, of approximately 135° in respect to a horizontal line 10.

In accordance with a second preferred embodiment of the present invention there is provided a delivery device 21 above the delivery belt 9. This second printed product delivery device 21 is generally similar to the first printed product delivery device 2 with the primary difference being that a further, or third chain wheel 18 arranged on a third shaft 17 is provided. Now two chain wheels 8, 18 are located above the delivery belt 9 as shown in FIG. 2. The two chain wheels 8, 18 can be arranged at a relatively large distance, but can also be positioned closely one behind the other. A plurality of paddles 12, for example 50 to 60, can be arranged on a paddle chain 19 in this second delivery device 21.

Together, the chain wheels 7, 8, 18 guide the endless roller or paddle chain 19, which is designed analogously to the paddle chain 11 of the first delivery device 2. Because of the arrangement of the third chain wheel 18, a delivery path D is created between the second chain wheel 8 and the third chain wheel 18, along which a gradual, or a gentle removal of the printed products out of the paddle chain 19 is made possible. This is achieved in that the paddle chain 19 moves on a line 25 which is held parallel in respect to the upper belt 14 of the delivery belt 9 in the area of the printed products delivery path D. A product removal device 20 is arranged at a larger obtuse angle of approximately 150° in respect to the parallel line 25. The delivery quality of the printed product is improved in this way.

The second or the third chain wheels 8 or 18 can be used as the drive wheel.

Depending on the width of the printed products, several chain wheels 7, 8, 18 will be arranged at axial distances from each other on each shaft 4, 6, 17, each of the chain wheels 7, 8, 18 support endless paddle chains 18 and together they receive the printed products in a paddle pocket 13.

Other traction means, such as belts, toothed belts or cables can be used in place of roller chains 11 or 19 in the first two embodiments 2 and 21.

Figure 4:
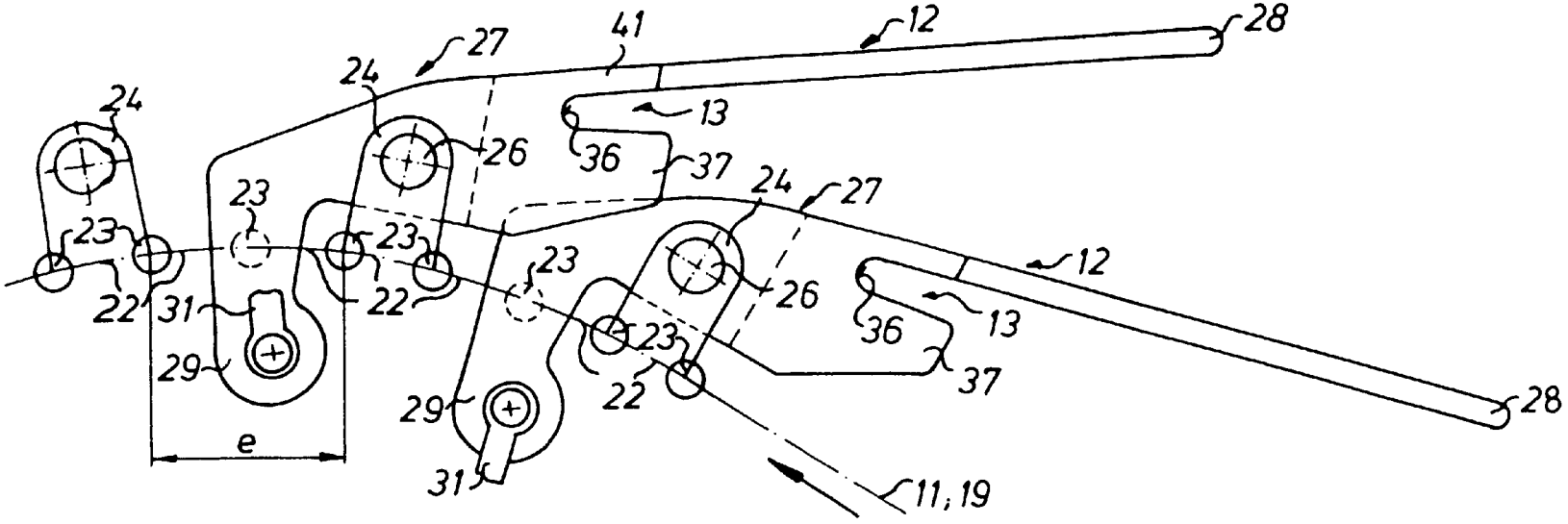
FIG. 4, a lateral view of two paddles with the paddle chain symbolically represented.
Figure 5:
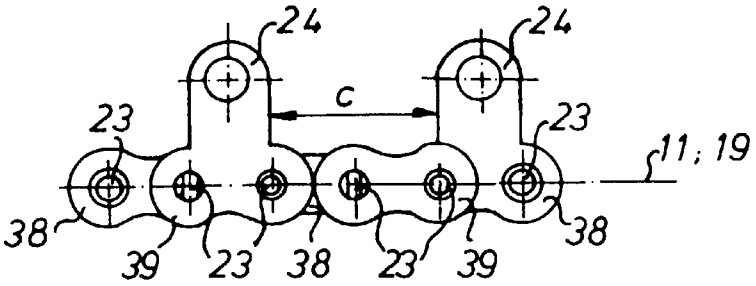
FIG. 5, a lateral view of the paddle chain with tongues, but without paddles; and in FIG. 6, a schematic representation of a lateral view of a delivery device in a third preferred embodiment with a paddle wheel, which has a plurality of paddles.

The paddle chain 11, 19 can be designed as described in a manner as follows, and as shown, for example in FIGS. 3 to 5. The chain links 22 are alternatingly designed as inner links 38 or as outer links 39, as depicted in FIG. 5. Each chain link 22 is connected by means of chain bolts 23 with the neighboring chain link 22. Selected ones of the chain links 22 have tongues 34 pointing in the direction of the paddles 12 and separated longitudinally from adjacent tongues 24 at a clear distance e of two chain links 22 as seen in FIGS. 4 and 5. The tongues 24 are fastened alternatingly and opposite each other on both inner links 38 and on an outer links 39 of claim 11 or 19. The tongues 24 respectively each have a bore for receiving a common bolt 26. The bolt 26 supports a two-armed paddle holder 27, which is pivotably seated on the chain link 22.

A first arm or paddle arm 41 of the paddle holder 27 receives the paddle 12, which has a paddle tip 28. A second arm or control arm 29 pointing in the direction of the paddle chain 11, is for example embodied to be L-shaped, i.e. as an angled lever. The end of the second or control arm 29 points in the direction opposite the tongues 24 and is connected with a first end 31 of a coupler 32, or of a coupler 33 with these couplers 32 and 33 being shown in FIG. 3. A second end 34 of the coupler 32, or of the couple 33, is hingedly connected with the seventh trailing chain bolt 23.

Each coupler 32, 33 is generally U-shaped, for example. So that the couplers 32, 33 do not interfere with each other when their ends overlap, they are oriented so they face each other with their open U-shaped elements. Moreover, the couplers 32 are arranged on one side of the paddle chain 11, 19 in the conveying direction, and the couplers 33 are arranged on the other side of the paddle chain 11, 19.

The paddle holders 27 are designed in such a way that a projection 37 extending in the vicinity of a paddle bottom 36 is narrower than an opening between the two angled control arms 29. The projection 37 of a paddle holder 21 can therefore be introduced into the opening between the two control arms 29. A solid guidance of the individual chain links 22 is provided in this way. Therefore the paddles 12 partially overlap each other.

The paddle holders 27, and therefore the paddles 12, are pivotably seated on the paddle chain 11, 19 because of the arrangement of the couplers 32, 33 between the control arms 29 of the paddle holders 27 and a trailing chain bolt 23 of the paddle chain 11, 19. Therefore a radius r28 of a curve, through which the paddle tips 28, including the couplers 32, 33, pass in the reversing area of the paddle chain 11, 19, is less than would be the case without the inclusion of the couplers 32, 33. This is of particular advantage in the reversing area of the paddle chain 11, 19 around the lower chain wheel 8 shown in FIG. 1, because the printed products are delivered to the delivery belt 9 by gentle removal, which aids in increasing the delivery quality.

In order to achieve a comparatively small radius r28 of the paddle tips 28 in the reversing area of the paddle chain 11, 19, it is also possible to attach freely rotatable control rollers on the control arms 29, instead of the couplers 32, respectively arranged between the control arms 29 and the paddle chain 11. These control rollers will then roll off, frictionally connected, on a control cam fixed in place on the lateral frame. The result of this is that a radius r29 of a curve, through which the ends of the control arms 29 pass in the reversing area of the paddle chain 11, 19, is less than a radius of a chain wheel 7, 8.

It is furthermore possible to attach a clamping device in the paddle bottom 36 of each paddle holder arm 41, which clamps the printed product after it has been placed into the paddle pocket 13 and only releases it again prior to reaching the removal device 15, 20.

Such a clamping device can consist of a movable clamping jaw, on which a spring force acts, and which acts against the fixed paddle holder arm 41. For example, by means of a cam-controlled lever arm, the movable clamping jaw can be temporarily brought into an opening position, i.e. for picking up and releasing printed products.

Figure 6:
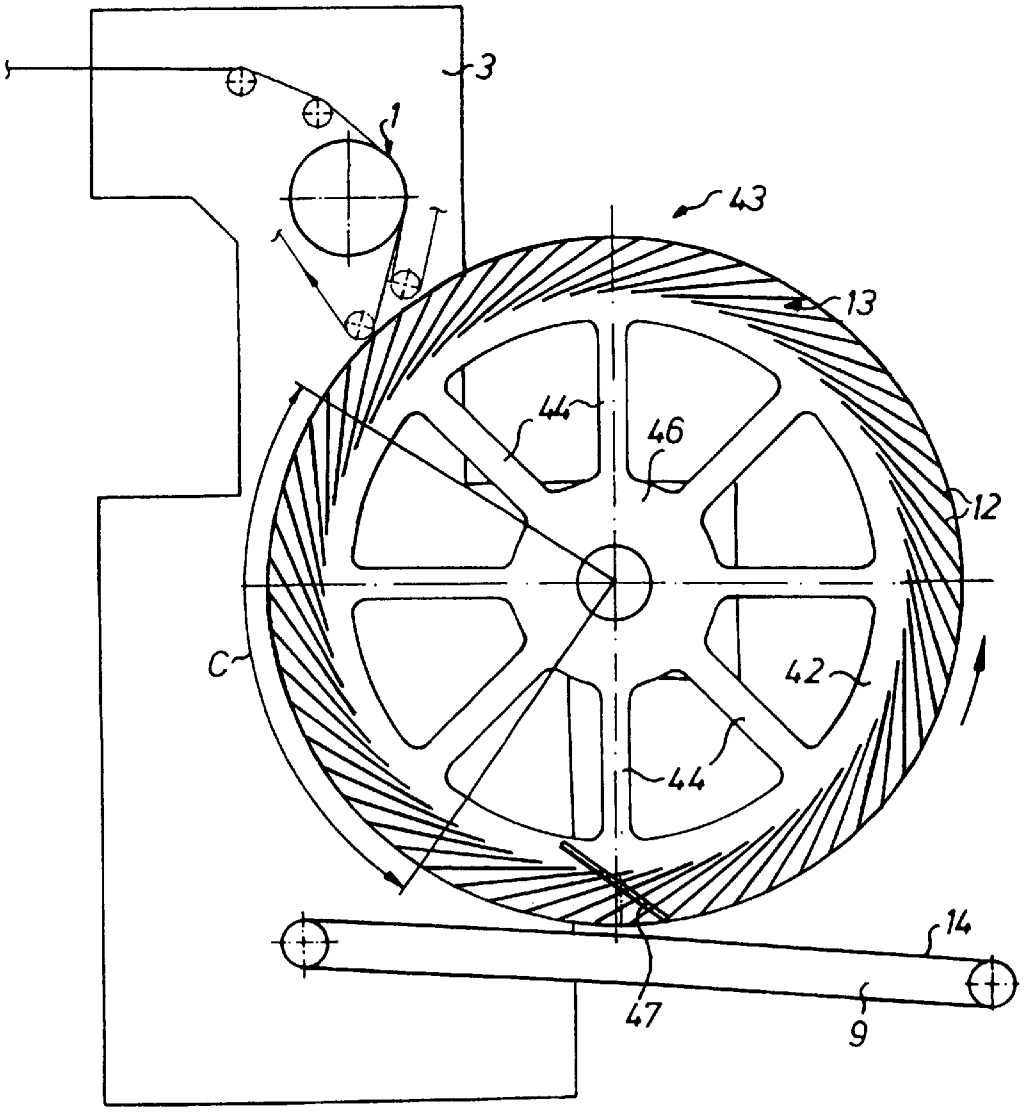

In accordance with a third preferred exemplary embodiment of the present invention, as seen in FIG. 6, a steadying path C extending in a vertical direction has a curved section.

Here, an endless carrier, for example a ring-shaped paddle holder 42 of a paddle wheel 43, is used. The paddle holder 42 is supported by means of spokes 44, which are connected with a hub 46 in a radial direction. The paddle wheel 42 has a plurality of paddles 12, for example 35 to 65 paddles 12, on the circumference of its ring-shaped paddle 12 holder 42. The paddles can be designed straight, or also can be slightly curved. The printed products are delivered in an imbricated or shingled manner on a delivery belt 9 by means of a removal device 47.

While preferred embodiments of a device for guiding printed products in accordance with the present invention have been set forth fully and completely hereinabove, it will be apparent to one of skill in the art that a number of changes in, for example, the type of printing press used to print the products, the type of belt guide system used to supply the printed products to the device for guiding the printed products, and the like may be made without departing from the true spirit and scope of the present invention which is accordingly to be limited only by the following claims.

What is claimed is:

1. A device for guiding printed products composing:

an endless carrier;

a plurality of paddles secured to said endless carrier for pivotal movement, said plurality of paddles partially overlapping; and coupler means connecting said paddles and said carrier, said coupler means causing said paddles to pivot on said carrier in response to movement of said carrier.

2. The device of claim 1 wherein said endless carrier is a traction means.

3. The device of claim 1 wherein each said coupler means includes a generally u-shaped coupler.

4. The device of claim 1 wherein each of said paddles is straight.

5. The device of claim 1 wherein each of said paddles is curved.

6. The device of claim 1 wherein said endless carrier is a cable.

7. The device of claim 1 wherein said endless carrier is a belt.

8. The device of claim 1 wherein said endless carrier is a toothed belt.

9. The device of claim 1 further including a plurality of paddle arm holders each having a paddle bottom, each said paddle being secured to a cooperating one of said paddle arm holders and further including a printed product clamping device in each said paddle bottom.

10. The device of claim 9 wherein said clamping device includes a movable clamping jaw with a spring force acting on each movable clamping jaw, said movable clamping jaw acting against said paddle arm holder, and a movable lever arm for moving said movable clamping jaw into an opening position.

11. The device of claim 1 wherein said endless carrier is a paddle chain.

12. The device of claim 11 wherein said paddle chain is comprised of a plurality of chain links with selected ones of said chain links having tongues and further including paddle holders secured to said tongues, said paddle holders each having a paddle holder arm, each one of said plurality of paddles being secured to a paddle holder arm.

13. The device of claim 12 wherein each said paddle holder includes a control arm, each said control arm being angled.

14. The device of claim 13 further including at least one reversing chain wheel about which said paddle chain travels, said reversing chain wheel having a chain wheel radius and wherein a curve defined by ends of said control arms as said paddle chain passes around said reversing chain wheel has a curve radius less than said chain wheel radius.

15. The device of claim 13 further including a chain bolt for each of said chain links and wherein an end of each said control arms is connected to said chain bolt of a trailing chain link by said coupler means.

16. The device of claim 13 further including a freely rotatable control roller secured to an end of each said control arm and engageable with a fixed control cam.

* * * * *